US005632489A

United States Patent [19]

Rozzi, Sr. et al.

[11] Patent Number: 5,632,489

[45] Date of Patent: May 27, 1997

[54] METHOD OF PLAYING A SEVEN AND A HALF CARD GAME

[76] Inventors: Andrew Rozzi, Sr.; Andrew Rozzi, Jr., both of 307 N. Lafayette St., New Castle, Pa. 16102-1870

[21] Appl. No.: 582,553

[22] Filed: Jan. 2, 1996

[51] Int. Cl.[6] ..... A63F 1/00

[52] U.S. Cl. ..... 273/304; 273/292

[58] Field of Search ..... 273/292, 274, 273/309, 304

[56] References Cited

PUBLICATIONS

"Bridgepoint Playing Cards", New York Times Magazine Jan. 1955.

"Seven and a Half", Scarne's Encyclopedia of Games, John Scarne, Harper & Row Publishers, pp. 288–289 1973.

"Super Blackjack", Casino Gaming Concepts, Inc 1993.

*Primary Examiner*—Benjamin H. Layno

*Attorney, Agent, or Firm*—Michael I. Kroll

[57] ABSTRACT

A seven and a half card game (10) comprising a deck of modified playing cards (12) for distribution of cards (14) to each player (16) and a dealer (18). The cards (14) bear indicia representing a count value from between a half a point to seven and a half points that will be accumulated by each player (16) and the dealer (18). The object of the game (10) is for each player (16) to have a higher point count than the dealer (18), but not exceeding seven and a half points.

1 Claim, 2 Drawing Sheets

METHOD OF PLAYING A SEVEN AND A HALF CARD GAME

BACKGROUND OF THE INVENTION

1. Field of the Invention

The instant invention relates generally to card games and more specifically it relates to a seven and a half card game.

2. Description of the Prior Art

Numerous card games have been provided in prior art that are adapted to use a standard deck of playing cards containing indicia representing certain values and requiring the players to obtain combinations of such cards in order to triumph and win over their opponents. While these units may be suitable for the particular purpose to which they address, they would not be as suitable for the purposes of the present invention as heretofore described.

SUMMARY OF THE INVENTION

A primary object of the present invention is to provide a seven and a half card game that will overcome the shortcomings of the prior art devices.

Another object is to provide a seven and a half card game in which each player is to be dealt no more than two cards having a higher count than the dealer, but not exceeding seven and a half points.

An additional object is to provide a seven and a half card game that can be made in two forms being a casino version and a home version that are played in slightly different ways, whereby they both utilize a modified deck of playing cards, but the home version includes a set of chips to represent betting money.

A further object is to provide a seven and a half card game that is simple and easy to use.

A still further object is to provide a seven and a half card game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
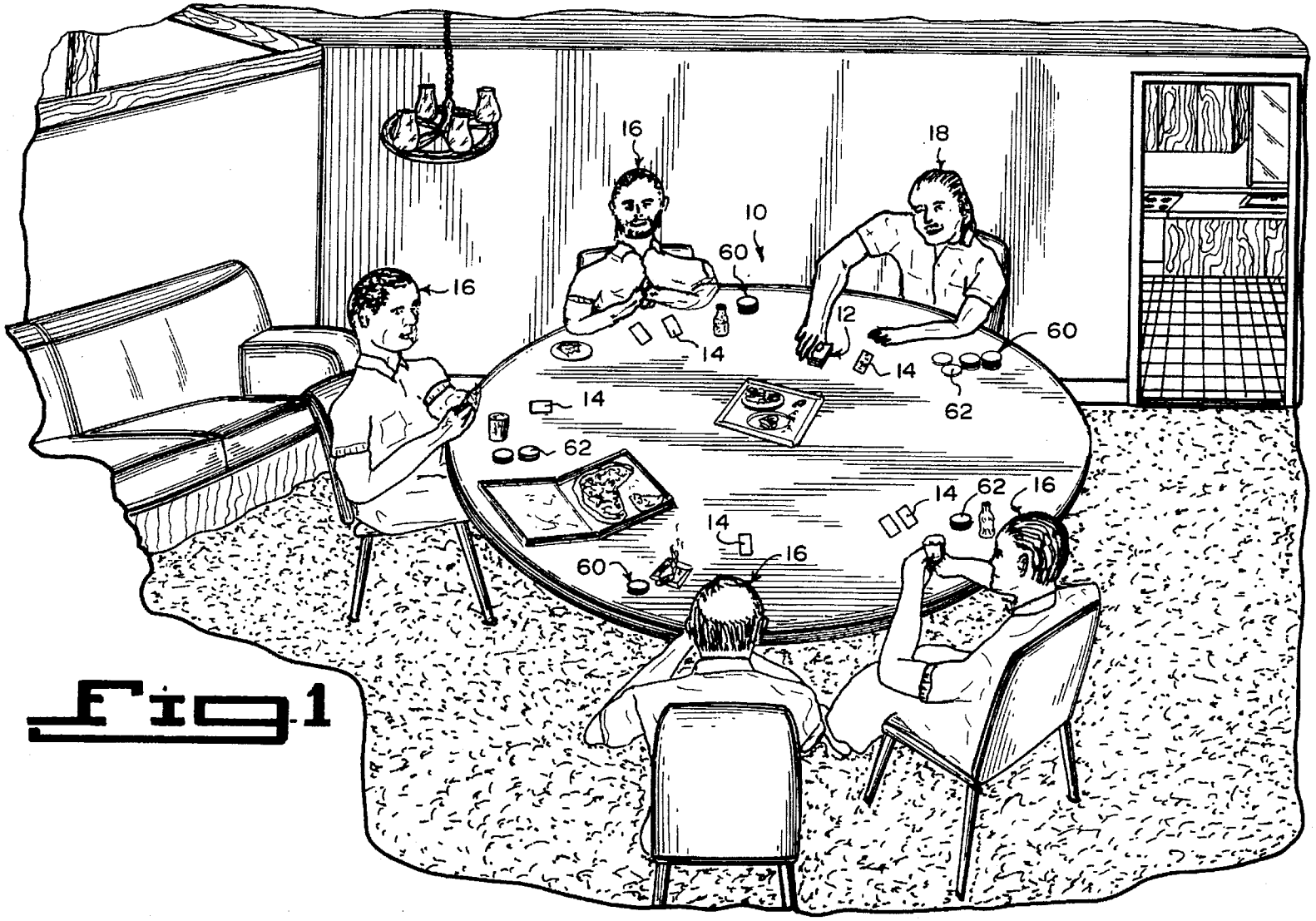
FIG. 1 is a perspective view showing the instant invention being played on a table by five players.
Figure 2:
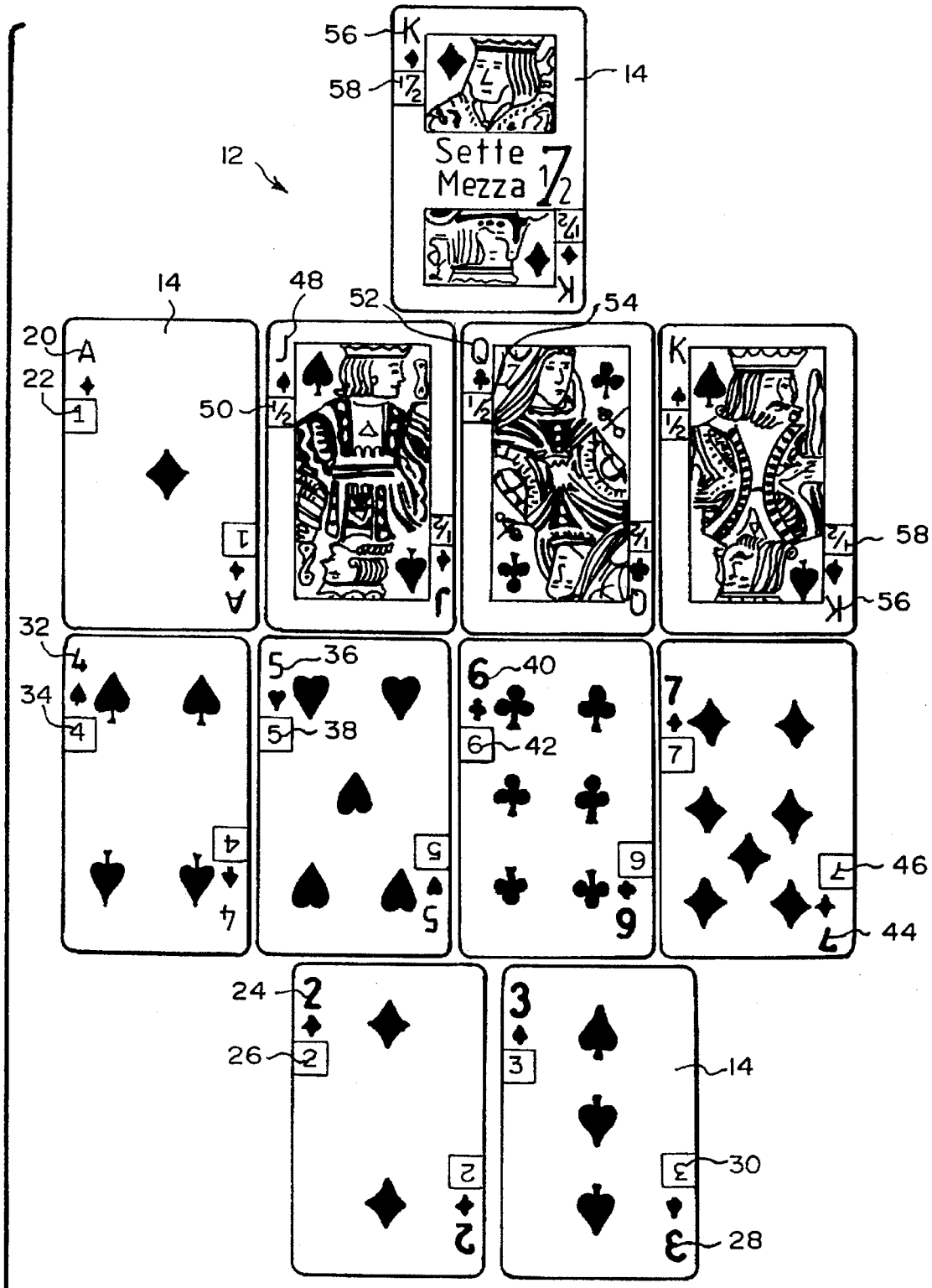
FIG. 2 is a plan view typically representing some of the modified cards used in the deck of playing cards for the game.

Turning now descriptively to the drawings, in which similar reference characters denote similar elements throughout the several views, FIGS. 1 and 2 illustrate a seven and a half card game 10 comprising a deck of modified playing cards 12 for distribution of cards 14 to each player 16 and a dealer 18. The cards 14 bear indicia representing a count value from between a half a point to seven and a half points that will be accumulated by each player 16 and the dealer 18. The object of the game is for each player 16 to have a higher point count than the dealer 18, but not exceeding seven and a half points.

The deck of modified playing cards 12 has all of the eight, nine and ten cards removed therefrom, thereby reducing the total amount of the cards 14 in the deck 12 from fifty two to forty in number. The deck of modified playing cards 12 include heart, diamond, club and spade suits located upon the face of the cards 14.

The deck of modified playing cards 12 include a first set of four cards, each with an ace designation 20, being an ace of hearts, an ace of diamonds, an ace of clubs and an ace of spades, having indicia indications 22 representing a numeric count of one point. The ace of diamonds is shown in FIG. 2.

A second set of four cards are provided, each with a two designation 24, being a two of hearts, a two of diamonds, a two of clubs and a two of spades, having indicia indications 26 representing a numeric count of two points. The two of diamonds is shown in FIG. 2.

A third set of four cards are provided, each with a three designation 28, being a three of hearts, a three of diamonds, a thereof clubs and a three of spades, having indicia indications 30 representing a numeric count of three points. The three of spades is shown in FIG. 2.

A fourth set of four cards are provided, each with a four designation 32, being a four of hearts, a four of diamonds, a four of clubs and a four of spades, having indicia indications 34 representing a numeric count of four points. The four of spades is shown in FIG. 2.

A fifth set of four cards are provided, each with a five designation 36, being a five of hearts, a five of diamonds, a five of clubs and a five of spades, having indicia indications 38 representing a numeric count of five points. The five of hearts is shown in FIG. 2.

A sixth set of four cards are provided, each with a six designation 40, being a six of hearts, a six of diamonds, a six of clubs and a six of spades, having indicia indications 42 representing a numeric count of six points. The six of clubs is shown in FIG. 2.

A seventh set of four cards are provided, each with a seven designation 44, being a seven of hearts, a seven of diamonds, a seven of clubs and a seven of spades, having indicia indications 46 representing a number count of seven points. The seven of diamonds is shown in FIG. 2.

An eighth set of four cards are provided, each with a jack designation 48, being a jack of hearts, a jack of diamonds, a jack of clubs and a jack of spades, having indicia indications 50 representing a numeric count of a half point. The jack of spades is shown in FIG. 2.

A ninth set of four cards are provided, each with a queen designation 52, being a queen of hearts, a queen of diamonds, a queen of clubs and a queen of spades, having indicia indications 54 representing a numeric count of a half point. The queen of clubs is shown in FIG. 2.

A tenth set of four cards are provided, each with a king designation 56, being a kind of hearts, a king of diamonds, a king of clubs and a king of spades, having indicia indications 58 representing a numeric count of a half point. The king of spades is shown in FIG. 2. The king of diamonds also shown in FIG. 2, has an numeric count of seven and a half points when first dealt to one of the players 16 and the dealer 18 and a numeric count of a half point when dealt out at other times. The seven and a half card game 10 can further include a plurality of playing chips 60, being small round flat disks 62 used to represent money for betting during the play of the game.

THE RULES FOR PLAYING THE PRESENT GAME AS A CASINO VERSION ARE AS FOLLOWS:

THE OBJECT OF THE GAME:

1. A player attempts to beat the dealer by obtaining two cards or less whose face value(s) are greater than that of the dealer's two cards or less hand.
2. The total(s) of the one to two card hand must be seven and a half or less. Scoring greater than seven and a half is an automatic loss (or busting).

NUMBER OF PLAYERS:

There will be one to seven players plus the dealer.

NUMBER OF CARD DECKS:

1. One deck of cards.
2. The deck of cards contains forty cards with the eights, nines and ten omitted.
3. The deck is reshuffled after each hand.

CARD VALUES;

The king of diamonds is worth 7½ points, if dealt as the first card.

| | |
|---|---|
| A's = 1 point | 6's = 6 points |
| 2's = 2 points | 7's = 7 points |
| 3's = 3 points | J's = ½ point |
| 4's = 4 points | Q's = ½ point |
| 5's = 5 points | K's = ½ point |

THE DEAL:

PLAYER(S):

1. Each player places an ante bet on the table.
2. Each player is dealt one card face down on the table, while the dealer's card is face up on the table.
3. The player(s), after looking at their card, can either stand or draw(hit) one additional card after placing a final bet.
4. The player can elect to fold by not placing the final bet and will lose the ante bet.

DEALER:

1. The dealer can draw one additional card. If the dealer has a five or less he must hit. If he has a six he must stand.
2. When the king of diamonds is dealt as the first card to a player, he must immediately turn the card face up and he or she wins triple the amount bet.
3. When the dealer draws the king of diamonds as his first card he immediately wins and all cards and bet are collected.

TIES:

If the player and the dealer have the same total, the hand is a tie(push). There is no winner or loser. The player's bets are not collected.

PROBABLE OUTCOMES ON A ONE OR TWO CARD DRAW:

THE 780 TWO CARD COUNTS IN THE GAME:

| COUNT (POINTS) | WAYS IT CAN BE MADE |
|---|---|
| 14 | 6 |
| 13 | 16 |
| 12 | 22 |
| 11 | 32 |
| 10 | 38 |
| 9 | 48 |
| 8 | 54 |
| 7½ | 48 |
| 7 | 48 |
| 6½ | 48 |
| 6 | 38 |
| 5½ | 48 |
| 5 | 32 |
| 4½ | 48 |
| 4 | 22 |
| 3½ | 48 |
| 3 | 16 |
| 2½ | 48 |
| 2 | 6 |
| 1½ | 48 |
| 1 | 66 |
| NUMBER OF TWO CARD WAYS | 780 |
| NUMBER OF ONE CARD WAYS | +40 |
| TOTAL NUMBER OF WAYS | 820 |

DEALER'S HAND ON A ONE OR TWO CARD DRAW:

| CARD TOTAL | CARD COMBINATION(S) | WIN % | | TIE % | LOSS % |
|---|---|---|---|---|---|
| 1 | TWO FACE CARDS | 27.69** | (player bust %) | 5.98 (49/820) | 66.33 |
| 1½ | ACE-FACE CARD | 34.76 | (58/820) + (pb %) | 4.02 (33/820) | 61.23 |
| 2 | TWO ACES | 38.91 | (92/820) + (pb %) | 0.61 (5/820) | 60.48 |
| 2½ | TWO-FACED CARD | 41.35 | (112/820) + (pb %) | 4.02 (33/820) | 54.63 |
| 3 | ACE-TWO | 45.62 | (147/820) + (pb %) | 1.58 (13/820) | 52.80 |
| 3½ | THREE-FACE CARD | 49.15 | (176/820) + (pb %) | 4.02 (33/820) | 46.83 |
| 4 | ACE-THREE | 53.54 | (212/820) + (pb %) | 2.32 (19/820) | 44.14 |
| 4 | TWO TWOS | 53.30 | (210/820) + (pb %) | 2.56 (21.820) | 44.14 |
| 4½ | FOUR-FACE CARD | 57.69 | (246/820) + (pb %) | 4.02 (33/820) | 38.29 |
| 5 | ACE-FOUR | 61.96 | (281/820) + (pb %) | 3.54 (29/820) | 34.50 |
| 5 | TWO-THREE | 61.96 | (281/820) + (pb %) | 3.54 (29/820) | 34.50 |
| 5½ | FIVE-FACE CARD | 67.45 | (326/820) + (pb %) | 4.02 (33/820) | 28.53 |
| 6 | ACE-FIVE | 71.71 | (361/820) + (pb %) | 4.27 (35/820) | 24.02 |
| 6 | TWO-FOUR | 71.71 | (361/820) + (pb %) | 4.27 (35/820) | 24.01 |

-continued

DEALER'S HAND ON A ONE OR TWO CARD DRAW:

| CARD TOTAL | CARD COMBINATION(S) | WIN % | | TIE % | LOSS % |
|---|---|---|---|---|---|
| 6 | THREE-THREE | 71.47 | (359/820) + (pb %) | 4.51 (37/820) | 24.02 |
| 6 | SIX | 76.71 | (402/820) + (pb %) | 5.00 (41/820) | 18.29 |
| 6½ | SIX-FACE CARD | 77.93 | (412/820) + (pb %) | 4.02 (33/820) | 18.05 |
| 7 | ACE-SIX | 83.18 | (455/820) + (pb %) | 5.49 (45/820) | 11.33 |
| 7 | TWO-FIVE | 82.20 | (447/820) + (pb %) | 5.49 (45/820) | 12.31 |
| 7 | THREE-FOUR | 82.20 | (447/820) + (pb %) | 5.49 (45/820) | 12.31 |
| 7 | SEVEN | 87.69 | (492/820) + (pb %) | 6.22 (51/821) | 6.09 |
| 7½ | SEVEN-FACE CARD | 89.64 | (508/820) + (pb %) | 4.15 (34/820) | 2.5 |
| KING OF DIAMONDS | | 100 | ********** | ********** | ***** |

PLAYER WILL BUST (holding two card totals of 8, 9, 10, 11, 12, 13, 14): 27.69% (216/780)
PLAYER WILL BUST (holding two card totals of 8, 9, 10, 11, 12): 24.87% (194/780)

SCHEDULE OF PAY OUT:

1. The player's ante bet will equal $3, $5, $10 or $25 (casino's discretion).
2. The player's final bet will equal up to double the ante bet.
3. The house will match the winning player's ante bet plus the final bet.
4. A player receiving the king of diamonds as the first card dealt to that player will win triple the ante bet.
5. A player electing to fold following the first down card dealt to that player will lose the ante bet.
6. A dealer/player tie score will have no winner or loser and no money exchanged.

THE RULES FOR PLAYING THE PRESENT GAME AS A HOME VERSION ARE AS FOLLOWS:

THE OBJECT OF THE GAME:

1. A player attempts to beat the dealer by obtaining card(s) whose face value(s) are greater than that of the card(s) held by the dealer.
2. The total must be seven and a half or less. Scoring greater than seven and a half is an automatic loss(or busting).

NUMBER OF PLAYERS:

There will be one to seven players plus the dealer.

BETTING CHIPS AND CARD DECK:

1. The chips and cards can have a 7½ logo on them.
2. The deck of cards contains forty cards. There are no eights, nines, and tens in the deck.

CARDS AND THEIR VALUES:

The king of diamonds card is worth 7½ points if dealt as the first card, otherwise the face value is ½ point.

| | |
|---|---|
| A's = 1 point | 6's = 6 points |
| 2's = 2 points | 7's = 7 points |
| 3's = 3 points | J's = ½ point |
| 4's = 4 points | Q's = ½ point |
| 5's = 5 points | K's = ½ point |

THE SET UP AND DEAL:

1. A dealer is chosen among the players by a draw of a card from the deck. High card wins the deal. If there is a tie, draw another card to break the tie.
2. Each player and the dealer are given betting chips.
3. Each player now places an ante chip on the table. The cards are shuffled and the dealer deals in a clockwise fashion, one card face down on the table to each player.
4. The dealer's card is dealt face up on the table. At this time, if anyone has the king of diamonds, they must reveal the card and state that they have a win. A player having this win automatically beats the dealer and also becomes the new dealer. The player is paid by the dealer double their bet. After the hand is completed between the remaining players, the dealer surrenders the deck of cards to the player who drew the king of diamonds and that player now becomes the dealer.
5. If the dealer has the king of diamonds as his first card, he automatically wins collecting all bets and cards on the table. The cards are reshuffled and the next hand begins.
6. If no one has the king of diamonds as the first card dealt, play continues. The player(s) upon examining their first card and the card the dealer has showing face up on the table now must decide whether to stand or draw another card. Remember, in order to beat the dealer the face value(s) of the player's card(s) must be greater than that of the dealer and be under 7½ points.
7. Also, the dealer is the last to play his hand. The dealer's first card (unless he deals himself the king of diamonds will not be his last and his score will change. The dealer must draw a card as long as the face values of his cards total six points or less. When the dealers score is six points, he can draw no more cards. Dealer and player(s) now match hands to see who won.
8. If a player in the course of play draws a card that makes his score go over 7½ points, he loses and pays the dealer his ante bet.
9. If the dealer in the course of play draws a card that makes his score go over 7½ points, he or she loses and must pay the player(s) that remain in the game their ante bet.
10. If the dealer and player end up with the same score, it is a tie. No one wins or loses and no bets are exchanged.

THE DECK OF CARDS:

The backs of the cards can have the 7½ logo. There are forty cards, as described above, in the deck. Each card has the point value marked on the face of the card. The king of diamonds has 7½ located in the middle of the card.

LIST OF REFERENCE NUMBERS

10 seven and a half card game
12 deck of modified playing cards
14 card
16 player
18 dealer
20 ace designation on 14

22 indicia indication of one point on 14
24 two designation on 14
26 indicia indication of two points on 14
28 three designation on 14
30 indicia indication of three points on 14
32 four designation on 14
34 indicia indication of four points on 14
36 five designation on 14
38 indicia indication of five points on 14
40 six designation on 14
42 indicia indication of six points on 14
44 seven designation on 14
46 indicia indication of seven points on 14
48 jack designation on 14
50 indicia indication of a half point on 14
52 queen designation on 14
54 indicia indication of a half point on 14
56 king designation on 14
58 indicia indication of a half point on 14
60 playing chip
62 small round flat disk for 60

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of playing a casino card game whose object is to beat the dealer by obtaining two cards or less whose face value is greater than that of the dealer's two cards or less providing the player's cards do not have a face value in excess of seven and a half, said method comprising the steps of:

a) arranging around a table in a casino a house dealer and a number of players up to seven;

b) each of the players places an ante bet on the table;

c) the dealer deals out one card down to each of said players and one card open to himself from a deck consisting of cards in each of the hearts, diamonds, clubs and spade suits, bearing the numeric designations one through seven, jack, queen, and king, each numeric card bearing a numeric value equal to its designated number, and each of the jack, queen, and king cards bearing the numeric value of one half, the king of diamonds bearing an alternative face value of 7½ when played as the first card;

d) each player after looking at his card will either place a final bet on the table and draw only one additional card face up or fold by not placing the final bet and losing his ante bet to the dealer;

e) the dealer will stand if he has a six and will draw one additional card if he has a five or less;

f) any player who receives a king of diamonds as his down card will turn the card face up and win a predetermined multiple of his ante bet;

g) if the dealer receives the king of diamonds as the first card he immediately wins all of the ante bets; and h) if a player and dealer have the same total, the hand is a tie and the player receives return of his ante bet.

* * * * *